US010487685B2

(12) United States Patent
Fujimura et al.

(10) Patent No.: US 10,487,685 B2
(45) Date of Patent: Nov. 26, 2019

(54) PIPING SYSTEM CLEANING METHOD, PIPING SYSTEM, AND STEAM TURBINE PLANT

(71) Applicant: MITSUBISHI HITACHI POWER SYSTEMS, LTD., Kanagawa (JP)

(72) Inventors: Daiki Fujimura, Kanagawa (JP); Ayumu Kuroshima, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 162 days.

(21) Appl. No.: 15/544,330

(22) PCT Filed: Oct. 22, 2015

(86) PCT No.: PCT/JP2015/079862
§ 371 (c)(1),
(2) Date: Jul. 18, 2017

(87) PCT Pub. No.: WO2016/125345
PCT Pub. Date: Aug. 11, 2016

(65) Prior Publication Data

US 2017/0362955 A1 Dec. 21, 2017

(30) Foreign Application Priority Data

Feb. 3, 2015 (JP) ..... 2015-019673

(51) Int. Cl.

| | |
|---|---|
| ***F01D 25/00*** | (2006.01) |
| ***B08B 9/032*** | (2006.01) |
| ***F01K 7/16*** | (2006.01) |
| ***F01K 9/00*** | (2006.01) |
| ***F01K 13/00*** | (2006.01) |
| ***F28G 9/00*** | (2006.01) |

(52) U.S. Cl.
CPC ..... *F01D 25/002* (2013.01); *B08B 9/0328* (2013.01); *F01K 7/165* (2013.01);
(Continued)

(58) Field of Classification Search
CPC combination set(s) only.
See application file for complete search history.

(56) References Cited

U.S. PATENT DOCUMENTS 3,277,651 A * 10/1966 Augsburger ..... F01K 3/22 60/657
4,576,008 A * 3/1986 Silvestri, Jr. ..... F01K 9/04 60/662
2017/0211414 A1 7/2017 Fujimura et al.

FOREIGN PATENT DOCUMENTS

JP 56-120301 2/1955
JP 59-110810 6/1984
(Continued)

OTHER PUBLICATIONS

Notification of Reasons for Refusal dated Oct. 2, 2018 in Japanese Application No. 2015-019673, with English translation.
(Continued)

*Primary Examiner* — Erin F Bergner
(74) *Attorney, Agent, or Firm* — Wenderoth, Lind & Ponack, L.L.P.

(57) ABSTRACT

A piping system of a steam turbine plant is provided with: steam piping connected to a steam turbine; bypass piping which branches from the steam piping at a branching portion and which is connected to a condenser; a steam check valve provided between the branching portion of the steam piping and the steam turbine; and a turbine bypass valve provided in the bypass piping. A piping system cleaning method includes the steps of: connecting at least one valve of the steam check valve and the turbine bypass valve and a connecting portion provided between the turbine bypass valve of the bypass piping and the condenser, by using temporary piping having a foreign matter collecting portion; closing a flow path on the outlet side of the valve; cleaning the steam piping by supplying steam to the steam piping; and
(Continued)

sending the steam to the condenser through the temporary piping.

4 Claims, 11 Drawing Sheets

(52) U.S. Cl.
CPC ..... *F01K 9/00* (2013.01); *F01K 13/006* (2013.01); *F28G 9/00* (2013.01); *F05D 2220/31* (2013.01)

(56) References Cited

FOREIGN PATENT DOCUMENTS

| | | |
|---|---|---|
| JP | 62-82305 | 5/1987 |
| JP | 64-32005 | 2/1989 |
| JP | 2-218803 | 8/1990 |
| JP | 10-196310 | 7/1998 |
| JP | 2010-127224 | 6/2010 |
| JP | 2016-89656 | 5/2016 |

OTHER PUBLICATIONS

International Search Report dated Jan. 19, 2016 in International (PCT) Application No. PCT/JP2015/079862.
Written Opinion of the International Searching Authority dated Jan. 19, 2016 in International (PCT) Application No. PCT/JP2015/079862.
Notice of Reasons for Refusal dated Apr. 16, 2019 in Japanese Patent Application No. 2015-019673, with English-language translation.

* cited by examiner

PIPING SYSTEM CLEANING METHOD, PIPING SYSTEM, AND STEAM TURBINE PLANT

TECHNICAL FIELD

The present invention relates to a piping system cleaning method, a piping system, and a steam turbine plant.

BACKGROUND ART

A steam turbine plant is provided with a steam turbine and a piping system having piping through which steam flows. Blowing-out for removing foreign matter in the piping is carried out before the steam turbine plant is started up after the ending of construction for building the steam turbine plant, after the ending of remodeling, and after long-term stoppage. The blowing-out is processing of cleaning the piping by supplying steam to the piping and blowing off foreign matter in the piping by the steam.

In a case where the steam supplied to the piping in the blowing-out is released to the atmosphere (free-blown), a noise problem arises. Further, a problem occurs in that steam which has been changed in color due to rust of the piping is released to the atmosphere. Further, a problem occurs in that a large amount of water is required. In order to deal with these problems, a technique of sending the steam used for blowing-out to a condenser without releasing it to the atmosphere has been devised. PTL 1 discloses an example of a technique related to intra-system blowing in which the steam used for blowing-out is sent to a condenser.

CITATION LIST

Patent Literature

[PTL 1] Japanese Unexamined Patent Application Publication No. 02-218803

SUMMARY OF INVENTION

Technical Problem

If cleaning power that is a force of blowing off foreign matter is insufficient, a problem occurs in that a sufficient cleaning effect cannot be obtained.

An aspect of the present invention has an object to provide a piping system cleaning method in which lack of cleaning power can be prevented, a piping system, and a steam turbine plant.

Solution to Problem

According to a first aspect of the present invention, there is provided a piping system cleaning method in a steam turbine plant, in which the piping system includes steam piping which is connected to a steam turbine, bypass piping which branches from the steam piping at a branching portion and is connected to a condenser, a steam check valve which is provided between the branching portion of the steam piping and the steam turbine, and a turbine bypass valve which is provided in the bypass piping, the method including the steps of: connecting at least one valve of the steam check valve and the turbine bypass valve and a connecting portion provided between the turbine bypass valve of the bypass piping and the condenser, by using temporary piping having a foreign matter collecting portion; closing a flow path on the outlet side of the valve; cleaning the steam piping by supplying steam to the steam piping; and sending the steam to the condenser through the temporary piping.

According to the first aspect of the present invention, steam is supplied in a state where the valve and the connecting portion provided in the bypass piping are connected by the temporary piping. A pressure loss of the steam in a case where the temporary piping is provided is smaller than a pressure loss of the steam in a case where the temporary piping is not provided. In a case where the temporary piping is not provided, the steam passes through the valve and flows out from the outlet side of the valve. In that case, a pressure loss of the steam increases due to a muffler of the valve. As a result, there is a possibility that sufficient cleaning power may not be obtained. The valve and the connecting portion are connected by the temporary piping, whereby there is no influence of the pressure loss due to the muffler of the valve. For this reason, steam having a high flow speed and a high flow rate can be caused to flow, and thus lack of the cleaning power is prevented in the piping on the upstream side of the valve, which is a cleaning target. Further, the temporary piping has the foreign matter collecting portion, and therefore, the foreign matter is prevented from being sent to the condenser.

In the first aspect of the present invention, the foreign matter collecting portion may include an inertial filter provided in the temporary piping.

In this way, the foreign matter is collected in a state where a pressure loss is suppressed compared to a general filtration filter, and therefore, lack of cleaning power is prevented.

In the first aspect of the present invention, a pressure loss body which causes a pressure loss of the steam flowing through the temporary piping may be provided upstream of the inertial filter of the temporary piping, and in cleaning of the piping system, pressure of the steam in the temporary piping may be reduced by the pressure loss body.

In this way, the flow speed of the steam having a pressure reduced by the pressure loss body increases. The flow speed of the steam is increased due to the pressure loss body, whereby the collection efficiency of the foreign matter by the inertial filter provided downstream of the pressure loss body is improved.

In the first aspect of the present invention, the pressure loss body may include a temporary piping valve which is provided in the temporary piping.

In this way, the flow speed of the steam is increased by the temporary piping valve provided immediately before the inertial filter, and thus the foreign matter is efficiently collected by the inertial filter. A valve which is large in size and low in pressure loss is used as the temporary piping valve, whereby a pressure loss of the steam is suppressed, and thus lack of the cleaning power is prevented. Further, intermittent blowing in which an operation of supplying steam to the inertial filter and an operation of stopping the supply of steam are repeated can be carried out by the temporary piping valve.

In the first aspect of the present invention, the inertial filter may have a first pipe section which is connected to the valve, a second pipe section which is connected to the connecting portion, a bent portion which connects the first pipe section and the second pipe section, and a projecting section which is connected to the bent portion in an extension line direction of the first pipe section and has an internal space communicating with a flow path of the bent portion.

In this way, the foreign matter is collected in the projecting section by an inertial force.

In the first aspect of the present invention, the projecting section may be connected to a discharge pipe communicating with the outside of the piping system, and in cleaning of the piping system, at least some of foreign matter collected in the projecting section may be discharged to the outside of the piping system through the discharge pipe.

In this way, the foreign matter is prevented from staying at the projecting section.

In the first aspect of the present invention, a desuperheater which reduces a temperature of the steam may be provided between the connecting portion of the bypass piping and the condenser, and in cleaning of the piping system, a temperature of the steam which is sent to the condenser through the temporary piping may be reduced by the desuperheater.

In this way, steam having a high temperature is prevented from being sent to the condenser.

According to a second aspect of the present invention, there is provided a piping system of a steam turbine plant, including: steam piping which is connected to a steam turbine; bypass piping which branches from the steam piping at a branching portion and is connected to a condenser; a steam check valve which is provided between the branching portion of the steam piping and the steam turbine; a turbine bypass valve which is provided in the bypass piping; a connecting portion which is provided between the turbine bypass valve of the bypass piping and the condenser and to which temporary piping is detachably connected; and a closing member which closes an opening of the connecting portion when the temporary piping is not connected to the connecting portion.

According to the second aspect of the present invention, the temporary piping is connected to the connecting portion, whereby the steam used for blowing-out is sent to the condenser through the temporary piping. In this way, intra-system blowing is performed in a state where lack of cleaning power is prevented. The opening of the connecting portion is closed with the closing member, whereby a normal operation is performed.

In the second aspect of the present invention, the piping system may further include a desuperheater which is provided between the connecting portion of the bypass piping and the condenser and reduces a temperature of the steam.

In this way, steam having a high temperature is prevented from being sent to the condenser.

According to a third aspect of the present invention, there is provided a steam turbine plant including the piping system according to the second aspect.

According to the third aspect of the present invention, in intra-system blowing, lack of cleaning power is prevented, and thus a sufficient cleaning effect is obtained.

Advantageous Effects of Invention

According to the aspects of the present invention, a piping system cleaning method in which lack of cleaning power can be prevented, a piping system, and a steam turbine plant are provided.

DESCRIPTION OF EMBODIMENTS

Hereinafter, embodiments of the present invention will be described with reference to the drawings. However, the present invention is not limited thereto. The constituent elements of each embodiment described below can be appropriately combined. Further, there is also a case where some constituent elements are not used.

[Steam Turbine Plant]

Figure 1:
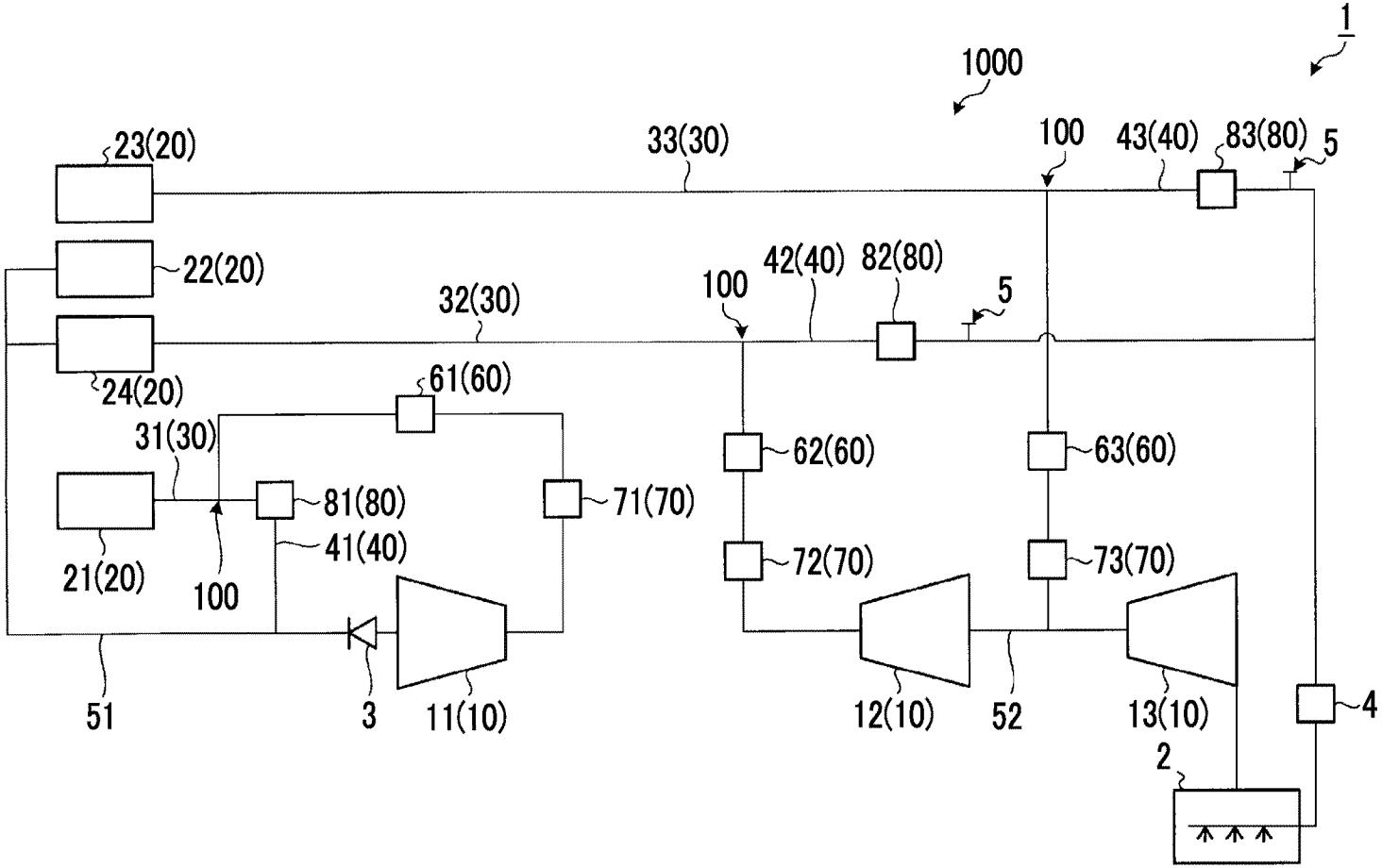
FIG. 1 is a diagram schematically showing an example of a steam turbine plant according to an embodiment.

FIG. 1 is a diagram schematically showing an example of a steam turbine plant 1 according to this embodiment. As shown in FIG. 1, the steam turbine plant 1 is provided with a steam turbine 10, a steam generator 20 which generates steam, and a piping system 1000 having piping through which steam flows.

The steam turbine 10 includes a high-pressure turbine 11, a medium-pressure turbine 12, and a low-pressure turbine 13.

The steam generator 20 includes a high-pressure heating unit 21, a medium-pressure heating unit 22, a low-pressure heating unit 23, and a reheat unit 24.

In this embodiment, the steam turbine plant 1 is combined with a gas turbine and a heat recovery steam generator to be used as a part of a gas turbine combined cycle (GTCC) power plant. The heat recovery steam generator (HRSG) generates steam by using high-temperature flue gas which is discharged from a gas turbine. The steam generator 20 includes the heat recovery steam generator. The steam generator 20 generates steam by using flue gas which is discharged from the gas turbine.

The steam generated in the steam generator 20 is supplied to the steam turbine 10 through the piping system 1000. The steam turbine 10 is operated by the supplied steam. A generator (not shown) is connected to the steam turbine 10. The generator is driven by the operation of the steam turbine 10. In this way, power generation is performed.

The high-pressure heating unit 21 includes a drum and a high-pressure superheater. The high-pressure heating unit 21 generates high-pressure steam. The medium-pressure heating unit 22 includes a drum. The medium-pressure heating unit 22 generates medium-pressure steam. The low-pressure heating unit 23 includes a drum and a low-pressure superheater. The low-pressure heating unit 23 generates low-pressure steam. The reheat unit 24 includes a repeater. The reheat unit 24 heats the steam discharged from the high-pressure turbine 11 and the steam supplied from the medium-pressure heating unit 22.

The piping system 1000 has steam piping 30 which is connected to the steam turbine 10 and through which the steam that is supplied to the steam turbine 10 flows, and bypass piping 40 which branches from the steam piping 30 at a branching portion 100. Further, the piping system 1000 has low-temperature reheat steam piping 51 which is connected to an outlet of the high-pressure turbine 11 and the reheat unit 24, and piping 52 which is connected to an outlet of the medium-pressure turbine 12 and an inlet of the low-pressure turbine 13.

The steam generated in the steam generator 20 is supplied to the steam turbine 10 through the steam piping 30 of the piping system 1000. At the time of the start-up of the steam turbine plant 1 or at the time of excessive pressure rise of the steam piping 30, steam flows into the bypass piping 40. Further, steam is supplied to the bypass piping 40 at the time of the start-up of the steam turbine plant 1, whereby the startability of the steam turbine plant 1 is improved.

The steam piping 30 includes high-pressure steam piping 31 which is connected to the high-pressure turbine and through which the steam that is supplied to the high-pressure turbine 11 flows, medium-pressure steam piping 32 which is connected to the medium-pressure turbine 12 and through which the steam that is supplied to the medium-pressure turbine 12 flows, and low-pressure steam piping 33 which is connected to the low-pressure turbine 13 and through which the steam that is supplied to the low-pressure turbine 13 flows.

The high-pressure steam piping 31 is disposed so as to connect the high-pressure heating unit 21 and the high-pressure turbine 11. An end portion of the high-pressure steam piping 31 is connected to an inlet of the high-pressure turbine 11. The steam generated in the high-pressure heating unit 21 is supplied to the high-pressure turbine 11 through the high-pressure steam piping 31.

The medium-pressure steam piping 32 is disposed so as to connect the reheat unit 24 and the medium-pressure turbine 12. An end portion of the medium-pressure steam piping 32 is connected to an inlet of the medium-pressure turbine 12. The steam generated in the reheat unit 24 is supplied to the medium-pressure turbine 12 through the medium-pressure steam piping 32.

The low-pressure steam piping 33 is disposed so as to connect the low-pressure heating unit 23 and the low-pressure turbine 13. An end portion of the low-pressure steam piping 33 is connected to an inlet of the low-pressure turbine 13. The steam generated in the low-pressure heating unit 23 is supplied to the low-pressure turbine 13 through the low-pressure steam piping 33.

The low-temperature reheat steam piping 51 is disposed so as to connect the outlet of the high-pressure turbine 11 and the reheat unit 24. In this embodiment, the steam discharged from the outlet of the high-pressure turbine 11 joins the steam from the medium-pressure heating unit 22 and is then supplied to the reheat unit 24 through the low-temperature reheat steam piping 51. The reheat unit 24 heats the steam discharged from the high-pressure turbine 11 and supplied thereto through the low-temperature reheat steam piping 51.

The bypass piping 40 includes high-pressure bypass piping 41 which branches from the high-pressure steam piping 31 at the branching portion 100, medium-pressure bypass piping 42 which branches from the medium-pressure steam piping 32 at the branching portion 100 and is connected to a condenser 2, and low-pressure bypass piping 43 which branches from the low-pressure steam piping 33 at the branching portion 100 and is connected to the condenser 2.

The high-pressure bypass piping 41 is disposed so as to connect the high-pressure steam piping 31 and the low-temperature reheat steam piping 51 (the outlet of the high-pressure steam turbine 11). The medium-pressure bypass piping 42 is disposed so as to connect the medium-pressure steam piping 32 and the condenser 2. The low-pressure bypass piping 43 is disposed so as to connect the low-pressure steam piping 33 and the condenser 2. Further, the piping system 1000 is provided with a desuperheater 4 which reduces the temperature of the steam which is sent to the condenser 2 through the medium-pressure bypass piping 42 or the low-pressure bypass piping 43.

The piping system 1000 has a plurality of valves. The valves include a steam check valve 60 which is provided in the steam piping 30, a control valve 70 which is provided in the steam piping 30, a turbine bypass valve 80 which is provided in the bypass piping 40, and a check valve 3 which is disposed in the low-temperature reheat steam piping 51. The steam check valve 60 is provided between the branching portion 100 of the steam piping 30 and the steam turbine 10.

In the following description, closing a flow path of the piping of the piping system 1000 by an operation of the valve is appropriately referred to as closing the valve, and opening the flow path of the piping of the piping system 1000 by an operation of the valve is appropriately referred to as opening the valve.

The steam check valve 60 can stop the supply of steam from the steam generator 20 to the steam turbine 10 by blocking the flow path of the steam piping 30. The steam check valve 60 is opened, whereby steam is supplied from the steam generator 20 to the steam turbine 10. The steam check valve 60 is closed, whereby the supply of steam from the steam generator 20 to the steam turbine 10 is stopped.

The steam check valve 60 includes a high-pressure steam check valve 61 which is provided between the branching portion 100 of the high-pressure steam piping 31 and the high-pressure turbine 11, a medium-pressure steam check valve 62 which is provided between the branching portion 100 of the medium-pressure steam piping 32 and the medium-pressure turbine 12, and a low-pressure steam check valve 63 which is provided between the branching portion 100 of the low-pressure steam piping 33 and the low-pressure turbine 13.

The high-pressure steam check valve 61 is opened, whereby steam is supplied from the high-pressure heating unit 21 to the high-pressure turbine 11. The high-pressure steam check valve 61 is closed, whereby the supply of steam from the high-pressure heating unit 21 to the high-pressure turbine 11 is stopped. The medium-pressure steam check valve 62 is opened, whereby steam is supplied from the medium-pressure heating unit 22 to the medium-pressure turbine 12. The medium-pressure steam check valve 62 is closed, whereby the supply of steam from the medium-pressure heating unit 22 to the medium-pressure turbine 12 is stopped. The low-pressure steam check valve 63 is opened, whereby steam is supplied from the low-pressure heating unit 23 to the low-pressure turbine 13. The low-pressure steam check valve 63 is closed, whereby the supply of steam from the low-pressure heating unit 23 to the low-pressure turbine 13 is stopped.

The control valve 70 can adjust the amount of steam which is supplied from the steam generator 20 to the steam turbine 10.

The control valve 70 includes a high-pressure control valve 71 which is provided in the high-pressure steam piping 31, a medium-pressure control valve 72 which is provided in the medium-pressure steam piping 32, and a low-pressure control valve 73 which is provided in the low-pressure steam piping 33.

The turbine bypass valve 80 can open and close the flow path of the bypass piping 40. The turbine bypass valve 80 is opened, whereby the steam from the steam generator 20 can flow through the bypass piping 40. The turbine bypass valve 80 is closed, whereby the flow of steam in the bypass piping 40 is cut off.

The turbine bypass valve 80 includes a high-pressure turbine bypass valve 81 which is provided in the high-pressure bypass piping 41, a medium-pressure turbine bypass valve 82 which is provided in the medium-pressure bypass piping 42, and a low-pressure turbine bypass valve 83 which is provided in the low-pressure bypass piping 43.

The high-pressure turbine bypass valve 81 is opened, whereby the steam from the high-pressure heating unit 21 can flow through the high-pressure bypass piping 41. The high-pressure turbine bypass valve 81 is closed, whereby the flow of steam in the high-pressure bypass piping 41 is cut off. The medium-pressure turbine bypass valve 82 is opened, whereby the steam from the reheat unit 24 can flow through the medium-pressure bypass piping 42. The medium-pressure turbine bypass valve 82 is closed, whereby the flow of steam in the medium-pressure bypass piping 42 is cut off. The low-pressure turbine bypass valve 83 is opened, whereby the steam from the low-pressure heating unit 23 can flow through the low-pressure bypass piping 43. The low-pressure turbine bypass valve 83 is closed, whereby the flow of steam in the low-pressure bypass piping 43 is cut off.

In this embodiment, the piping system 1000 is provided with a connecting portion 5 provided between the turbine bypass valve 80 of the bypass piping 40 and the condenser 2. In this embodiment, the connecting portion 5 is provided between the medium-pressure turbine bypass valve 82 of the medium-pressure bypass piping 42 and the condenser 2. Further, the connecting portion 5 is provided between the low-pressure turbine bypass valve 83 of the low-pressure bypass piping 43 and the condenser 2.

[Turbine Bypass Valve]

Figure 2:
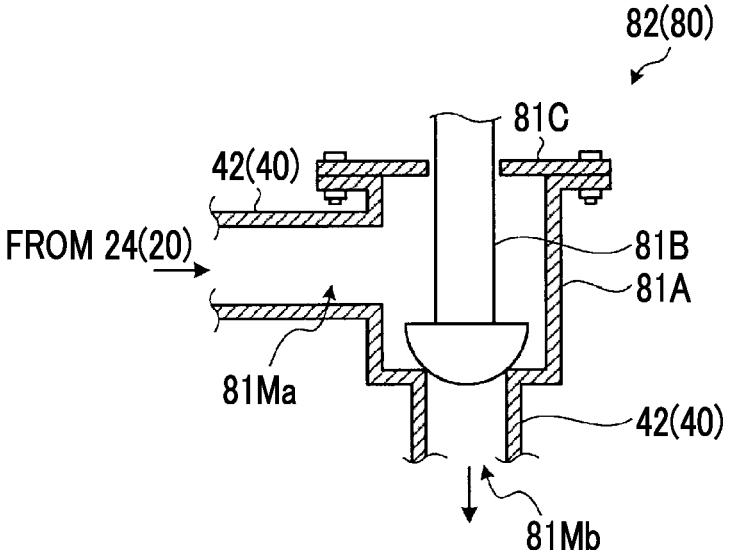
FIG. 2 is a cross-sectional view schematically showing an example of a turbine bypass valve according to the embodiment.

Next, the turbine bypass valve 80 according to this embodiment will be described. FIG. 2 is a cross-sectional view schematically showing an example of the medium-pressure turbine bypass valve 82 among the turbine bypass valves 80 according to this embodiment. As shown in FIG. 2, the medium-pressure turbine bypass valve 82 has a housing 81A, a valve body 81B, at least a part of which is disposed in an internal space of the housing 81A, and a lid member 81C which closes an opening of the housing 81A. The lid member 81C is fixed to the housing 81A by bolts.

The flow path of the medium-pressure bypass piping 42 is connected to the internal space of the housing 81A. The steam which is sent out from the reheat unit 24 and passes through the branching portion 100 and the medium-pressure bypass piping 42 flows into the internal space from an inlet side 81Ma of the housing 81A. The valve body 81B comes into contact with the housing 81A, whereby the flow path of the medium-pressure bypass piping 42 on an outlet side 81Mb of the housing 81A can be opened and closed.

When the flow path is closed by the valve body 81B, the steam from the reheat unit 24 is not supplied to the medium-pressure bypass piping 42 on the outlet side 81Mb. When the flow path is opened by the valve body 81B, the steam from the reheat unit 24 flows out from the outlet side 81Mb of the housing 81A.

The high-pressure turbine bypass valve 81 and the low-pressure turbine bypass valve 83 have the same structure as the medium-pressure turbine bypass valve 82, and therefore, the description thereof will be omitted.

[Connecting Portion]

Figure 3:
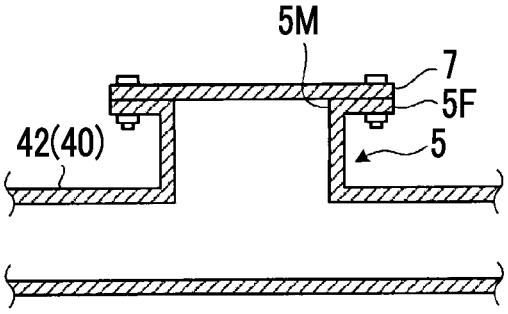
FIG. 3 is a cross-sectional view schematically showing an example of a connecting portion according to the embodiment.

FIG. 3 is a cross-sectional view schematically showing an example of the connecting portion 5 provided in the medium-pressure bypass piping 42 according to this embodiment. As shown in FIG. 3, the connecting portion 5 has an opening 5M provided in the medium-pressure bypass piping 42, and a flange section 5F which is disposed around the opening 5M. The opening 5M of the connecting portion 5 is closed by a closing member 7. The closing member 7 is fixed to the flange section 5F by bolts. The closing member 7 may be fixed to the flange section 5F by welding.

The connecting portions 5 provided in the high-pressure bypass piping 41 and the low-pressure bypass piping 43 have the same structure as the connecting portion 5 provided in the medium-pressure bypass piping 42, and therefore, the description thereof will be omitted.

[Flow of Steam during Normal Operation]

Figure 4:
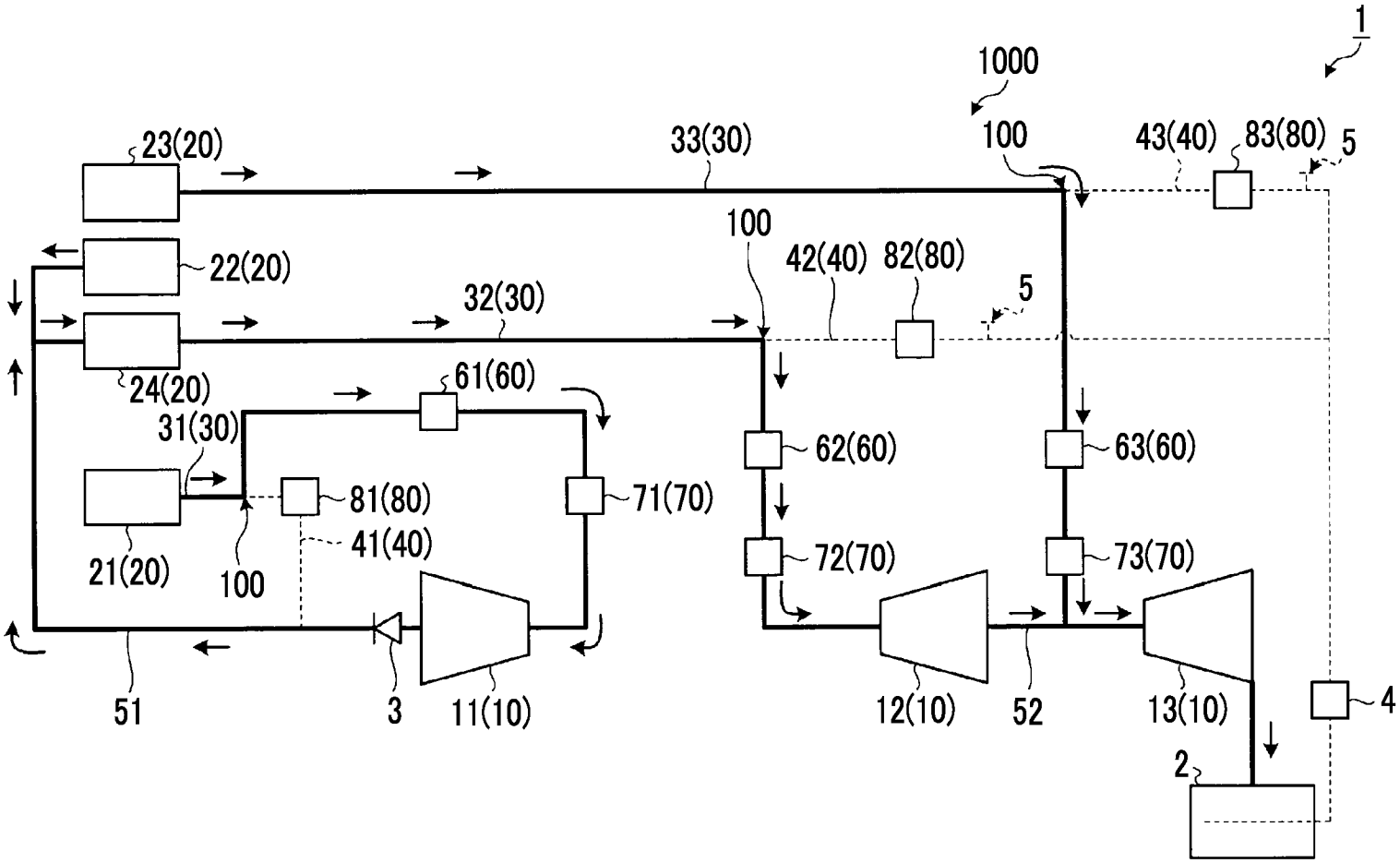
FIG. 4 is a diagram schematically showing an example of an operation of the steam turbine plant according to the embodiment.

Next, the flow of steam during a normal operation of the steam turbine plant 1 according to this embodiment will be described. FIG. 4 is a diagram schematically showing the flow of steam during a normal operation of the steam turbine plant 1 according to this embodiment. During the normal operation, the high-pressure steam check valve 61, the medium-pressure steam check valve 62, and the low-pressure steam check valve 63 are opened. The high-pressure turbine bypass valve 81, the medium-pressure turbine bypass valve 82, and the low-pressure turbine bypass valve 83 are closed. Further, during the normal operation, as described with reference to FIG. 3, the opening 5M of the connecting portion 5 is closed by the closing member 7.

The steam generated in the high-pressure heating unit 21 is supplied to the high-pressure turbine 11 through the high-pressure steam piping 31. The steam of the high-pressure steam piping 31 flows into the inlet of the high-pressure turbine 11. In this way, the high-pressure turbine 11 is operated. The steam flowing out from the outlet of the high-pressure turbine 11 is supplied to the reheat unit 24 through the low-temperature reheat steam piping 51.

The steam generated in the medium-pressure heating unit 22 is supplied to the reheat unit 24. The reheat unit 24 heats the steam supplied from the medium-pressure heating unit 22 and the steam supplied from the high-pressure turbine 11 through the low-temperature reheat steam piping 51. The steam reheated in the reheat unit 24 is supplied to the medium-pressure turbine 12 through the medium-pressure steam piping 32. The steam of the medium-pressure steam piping 32 flows into the inlet of the medium-pressure turbine 12. In this way, the medium-pressure turbine 12 is operated. The steam flowing out from the outlet of the medium-pressure turbine 12 is supplied to the low-pressure turbine 13 through the piping 52.

The steam generated in the low-pressure heating unit 23 is supplied to the low-pressure turbine 13 through the low-pressure steam piping 33. The steam of the low-pressure steam piping 33 flows into the inlet of the low-pressure turbine 13. In this embodiment, the steam from the low-pressure heating unit 23 and the steam from the medium-pressure turbine 12 are supplied to the low-pressure turbine 13. In this way, the low-pressure turbine 13 is operated. The steam flowing out from the outlet of the low-pressure turbine 13 is supplied to the condenser 2. The condenser 2 returns the steam supplied from the low-pressure turbine 13 to water.

[Blowing-Out]

Next, blowing-out according to this embodiment will be described. Blowing-out (flushing) for removing foreign matter in the piping of the piping system 1000 is carried out before the steam turbine plant 1 is started up after the ending of construction for building the steam turbine plant 1, after the ending of remodeling, and after long-term stoppage. The blowing-out is processing of cleaning the piping by supplying steam to the piping and blowing off the foreign matter in the piping by the steam.

For example, in the construction for building the steam turbine plant 1, piping welding processing is performed. Due to the welding processing, there is a possibility that foreign matter may be generated and remain in the piping. Further, there is a case where a welded portion is polished or cut with a grinder. There is a possibility that foreign matter may also be generated due to the polishing or the cutting. The blowing-out is carried out, whereby the foreign matter in the piping is removed.

Figure 5:
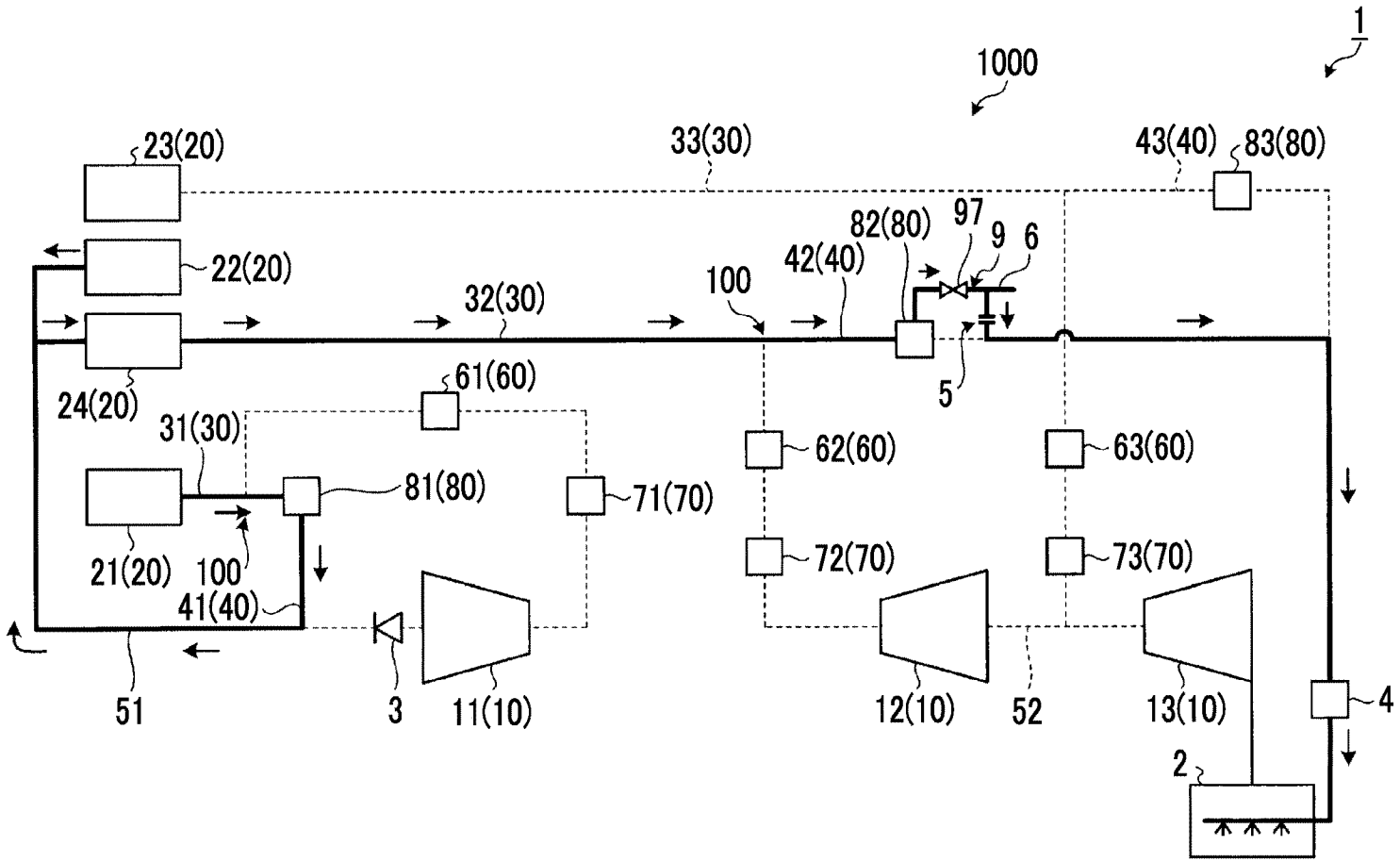
FIG. 5 is a diagram for describing an example of blowing-out according to the embodiment.
Figure 6:
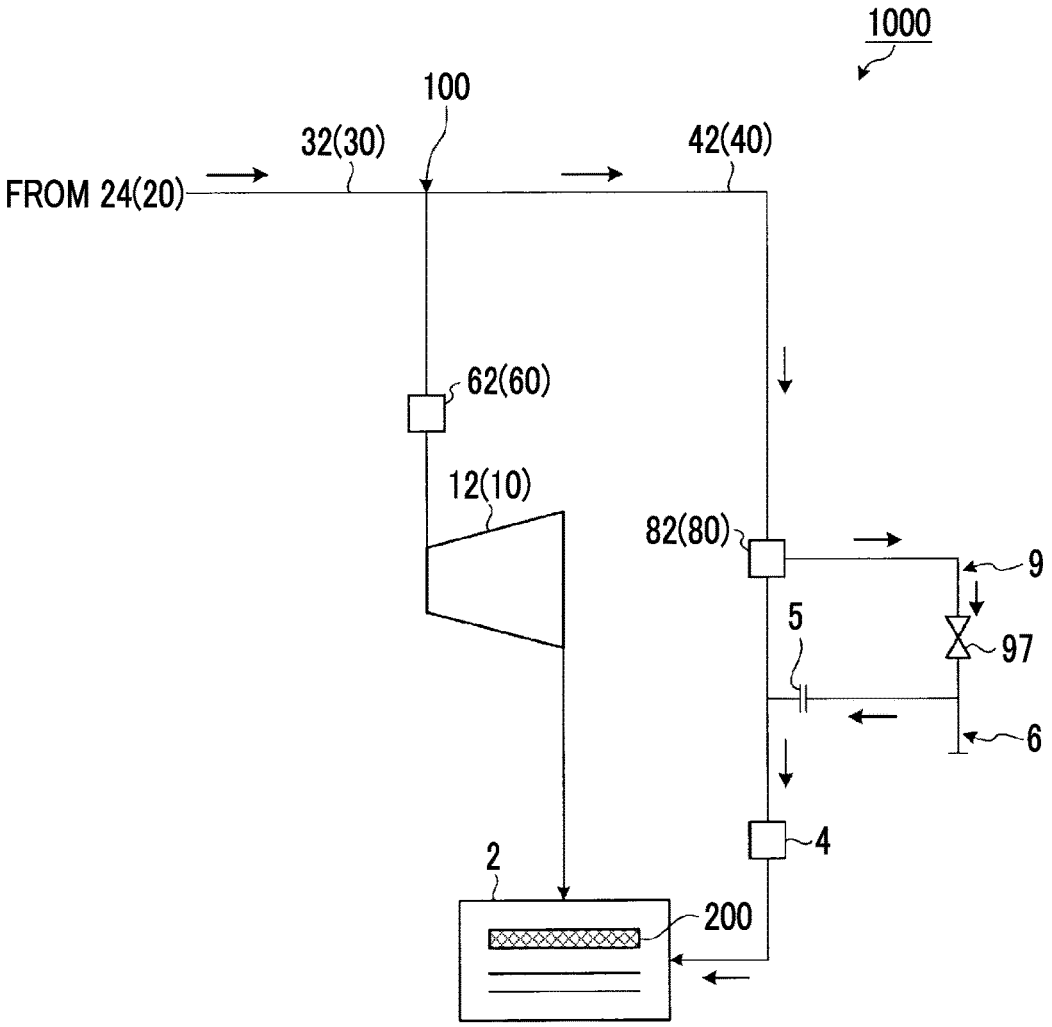
FIG. 6 is a diagram schematically showing an example of a piping system when the blowing-out according to the embodiment is carried out.

FIG. 5 is a diagram for describing an example of the blowing-out according to this embodiment. FIG. 6 is a diagram schematically showing a part of the piping system 100 when the blowing-out according to this embodiment is carried out. In the following description, an example in which the medium-pressure steam piping 32 and the medium-pressure bypass piping 42 on the upstream side of the medium-pressure turbine bypass valve 82 are mainly blown out will be described.

As shown in FIGS. 5 and 6, the piping system 1000 is provided with the medium-pressure steam piping 32 which is connected to the medium-pressure turbine 12, the medium-pressure bypass piping 42 which branches from the medium-pressure steam piping 32 at the branching portion 100 and is connected to the condenser 2, the medium-pressure steam check valve 62 which is provided between the branching portion 100 of the medium-pressure steam piping 32 and the medium-pressure turbine 12, the medium-pressure turbine bypass valve 82 which is provided in the medium-pressure bypass piping 42, the connecting portion 5 which is provided between the medium-pressure turbine bypass valve of the medium-pressure bypass piping 42 and the condenser 2 and to which temporary piping 9 is detachably connected, and the desuperheater 4 which is provided between the connecting portion 5 of the medium-pressure bypass piping 42 and the condenser 2 and reduces the temperature of the steam. The temporary piping 9 connects the medium-pressure turbine bypass valve 82 and the connecting portion 5.

In this embodiment, the cleaning processing of the piping system 1000, which includes the blowing-out, is carried out in a state where the medium-pressure turbine bypass valve 82 and the connecting portion 5 of the medium-pressure bypass piping 42 are connected through the temporary piping 9. In the blowing-out, one end portion of the temporary piping 9 is connected to the medium-pressure turbine bypass valve 82, and the other end portion of the temporary piping 9 is connected to the connecting portion 5 of the medium-pressure bypass piping 42. The connecting portion 5 of the medium-pressure bypass piping 42 is provided between the medium-pressure turbine bypass valve 82 and the condenser 2.

The temporary piping 9 has a foreign matter collecting portion 6. The foreign matter removed from the medium-pressure steam piping 32 by the blowing-out is collected by the foreign matter collecting portion 6.

Further, in this embodiment, a protective member 200 for protecting a cooling pipe of the condenser 2 is provided in the condenser 2. The protective member 200 includes a mesh member made of metal. The protective member 200 prevents the foreign matter from coming into contact with the cooling pipe of the condenser 2.

[Turbine Bypass Valve at the Time of Blowing-Out]

Figure 7:
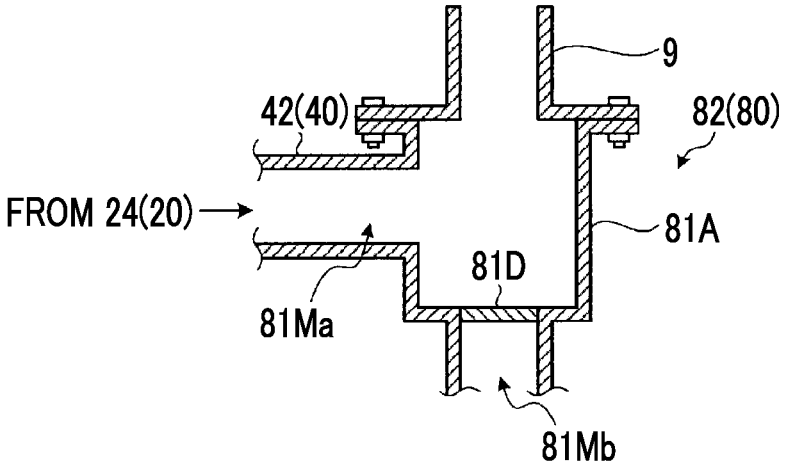
FIG. 7 is a cross-sectional view showing an example of a state where the turbine bypass valve and a temporary piping according to the embodiment are connected.

FIG. 7 is a cross-sectional view showing an example of a state where the medium-pressure turbine bypass valve 82 and the temporary piping 9 according to the embodiment are connected. In the blowing-out, the medium-pressure turbine bypass valve 82 and the temporary piping 9 are connected. In this embodiment, the temporary piping 9 is connected to the medium-pressure turbine bypass valve 82 in a state where the medium-pressure turbine bypass valve 82 is disassembled. That is, the valve body 81B and the lid member 81C (refer to FIG. 2) are removed from the housing 81A. The housing 81A and the medium-pressure bypass piping 42 are connected in a state where the valve body 81B and the lid member 81C are removed from the housing 81A, and the housing 81A and the temporary piping 9 are then connected. The temporary piping 9 is fixed to the housing 81A by bolts. Further, the flow path on the outlet side 81Mb of the medium-pressure turbine bypass valve 82 is closed by a closing member 81D.

[Connecting Portion at the Time of Blowing-Out]

Figure 8:
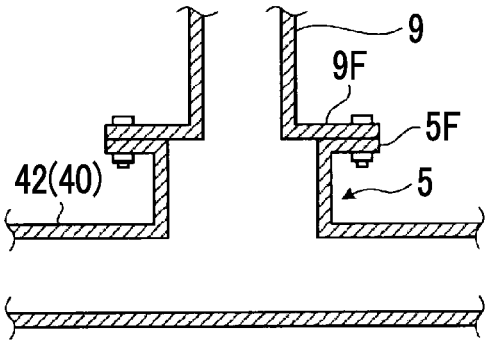
FIG. 8 is a cross-sectional view showing an example of a state where the connecting portion and the temporary piping according to the embodiment are connected.

FIG. 8 is a cross-sectional view showing an example of a state where the connecting portion 5 provided in the medium-pressure bypass piping 42 and the temporary piping according to the embodiment are connected. In the blowing-out, the connecting portion 5 and the temporary piping 9 are connected. The temporary piping 9 is attachable to and detachable from the connecting portion 5. As described with reference to FIG. 3, when the temporary piping 9 is not connected to the connecting portion 5, the opening 5M of the connecting portion 5 is closed by the closing member 7. When the temporary piping 9 is connected to the connecting portion 5, the closing member is removed from the connecting portion 5. The flange section 5F of the connecting portion 5 and a flange section 9F provided at the other end portion of the temporary piping 9 are fixed to each other by bolts. The flange section 9F and the flange section 5F may be fixed to each other by welding.

[Temporary Piping]

Figure 9:
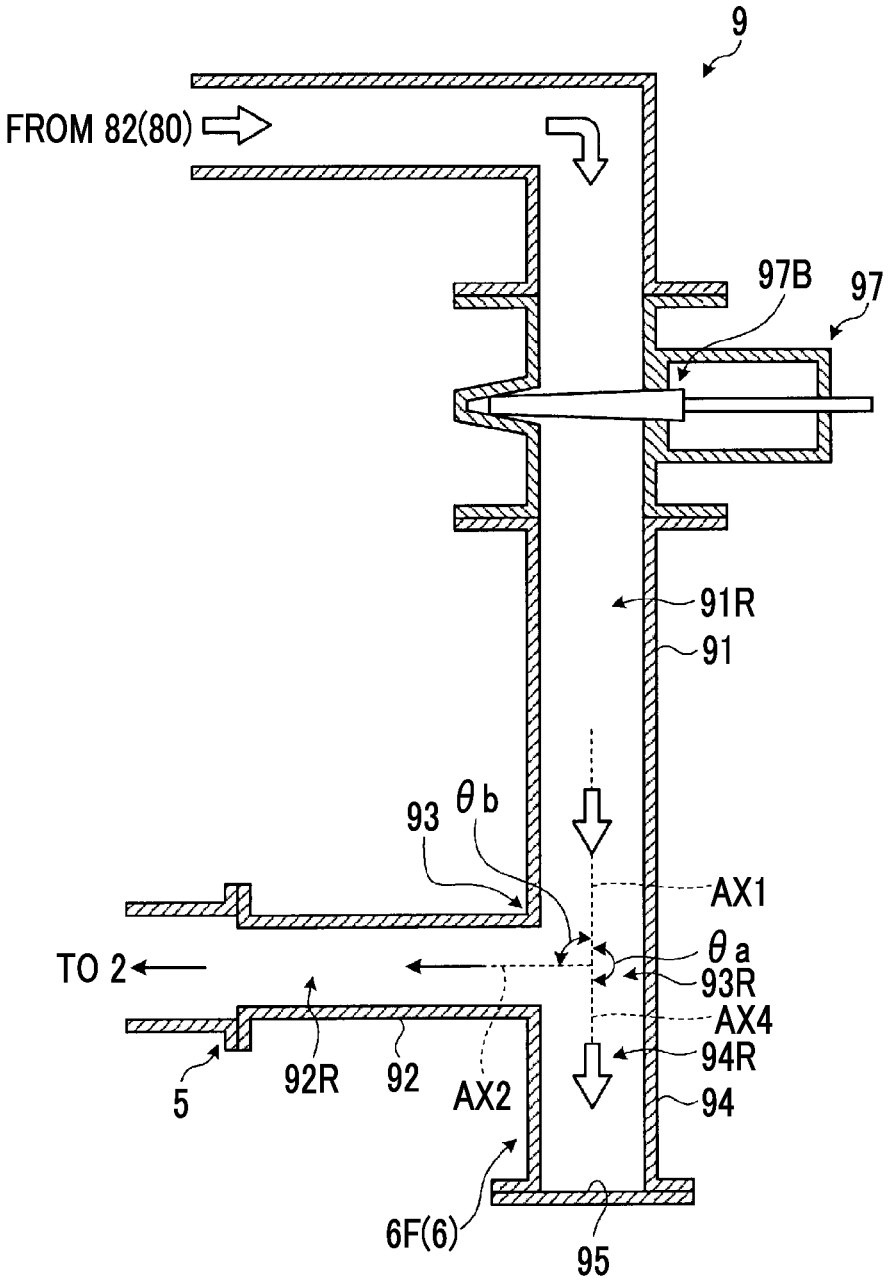
FIG. 9 is a sectional side view showing an example of the temporary piping according to the embodiment.

Next, an example of the temporary piping 9 according to this embodiment will be described. FIG. 9 is a sectional side view showing an example of the temporary piping 9 according to this embodiment. The temporary piping 9 has the foreign matter collecting portion 6. In this embodiment, the foreign matter collecting portion 6 includes an inertial filter 6F provided in the temporary piping 9.

As shown in FIG. 9, the inertial filter 6F has a first pipe section 91 which is connected to the turbine bypass valve 80, a second pipe section 92 which is connected to the connecting portion 5, a bent portion 93 which connects the first pipe section 91 and the second pipe section 92, and a projecting section 94 which is connected to the bent portion 93 in an extension line direction of the first pipe section 91 and has an internal space 94R communicating with a flow path 93R of the bent portion 93. The projecting section 94 has a closing part 95 which closes one end portion of the internal space 94R. The flow path 93R and the internal space 94R communicate with each other through an opening of the other end portion of the internal space 94R.

In the blowing-out, the steam having flowed through the medium-pressure steam piping 32 and passed through the medium-pressure turbine bypass valve 82 flows into the temporary piping 9 and is supplied to a flow path 91R of the first pipe section 91. The steam supplied to the flow path 91R of the first pipe section 91 includes foreign matter.

As shown in FIG. 9, in this embodiment, an angle θa which is formed between a central axis AX1 of the first pipe section 91 and a central axis AX4 of the projecting section 94 is larger than an angle θb which is formed between the central axis AX1 of the first pipe section 91 and a central axis AX2 of the second pipe section 92.

In this embodiment, the angle θa is 180[°], and the first pipe section 91 and the projecting section 94 form a straight pipe. The angle θb is 90[°].

In this embodiment, a pressure loss body 97 which causes a pressure loss of the steam flowing through the temporary piping 9 is provided upstream of the inertial filter 6F of the temporary piping 9. In the cleaning of the piping system 1000, the pressure of the steam flowing through the temporary piping 9 is reduced by the pressure loss body 97.

In this embodiment, the pressure loss body 97 includes a temporary piping valve 97B which is provided in the temporary piping 9. The pressure and the flow speed of steam are adjusted by adjusting the degree of opening of the temporary piping valve 97B. The temporary piping valve 97B is a valve which is larger in size and lower in pressure loss than the medium-pressure turbine bypass valve 82. A pressure loss of the temporary piping valve 97B in the fully open state is smaller than a pressure loss of the medium-pressure turbine bypass valve 82 in the fully open state. The temporary piping valve 97B may be an electrically-operated valve or may be an air-operated valve.

[Cleaning Method]

Figure 10:
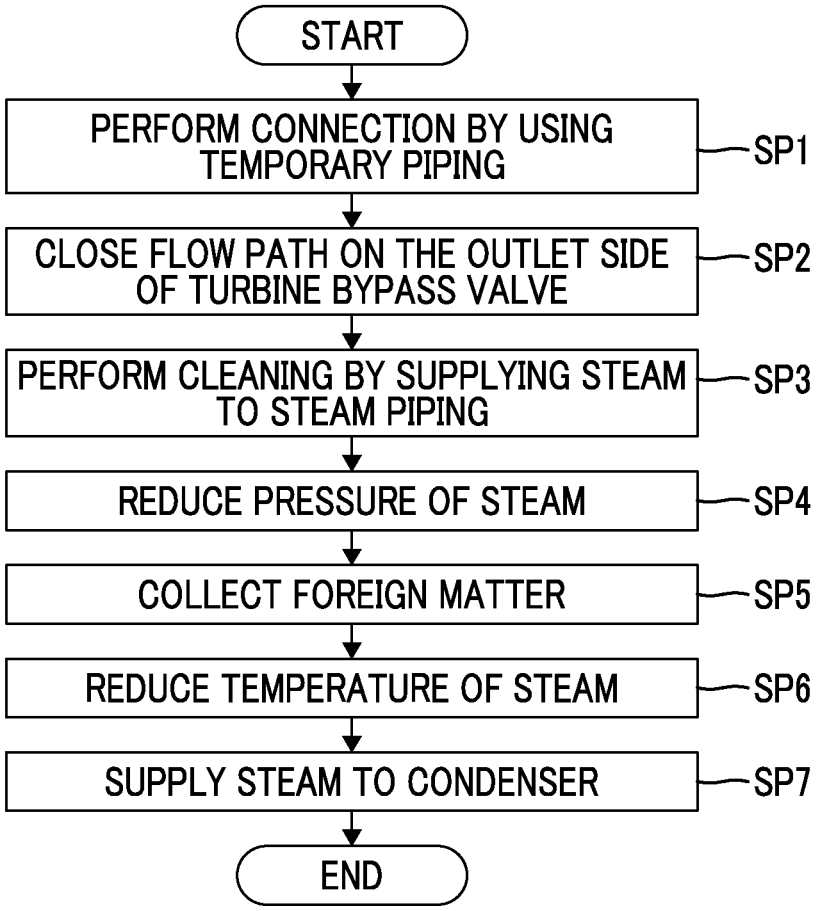
FIG. 10 is a flowchart showing an example of a piping system cleaning method according to the embodiment.

Next, a method of cleaning the piping system 1000 according to this embodiment will be described with reference to FIG. 10. FIG. 10 is a flowchart showing an example of the method of cleaning the piping system 1000 according to this embodiment.

The closing member 7 is removed from the connecting portion 5 and the medium-pressure turbine bypass valve 82 and the connecting portion 5 of the medium-pressure bypass piping 42 are connected by the temporary piping 9 (Step SP1).

The flow path on the outlet side 81Mb of the medium-pressure turbine bypass valve 82 is closed by the closing member 81D (Step SP2).

Steam is supplied from the reheat unit 24 to the medium-pressure steam piping 32. The foreign matter in the medium-pressure steam piping 32 is blown off by the steam supplied from the reheat unit 24 and is removed from the medium-pressure steam piping 32. In this way, the medium-pressure steam piping 32 is cleaned (Step SP3).

In the blowing-out, the medium-pressure steam check valve 62 is closed. The medium-pressure steam check valve 62 is closed, whereby the medium-pressure steam piping 32 is cleaned in a state where the steam used for the blowing-out and the foreign matter removed from the medium-pressure steam piping 32 by the blowing-out are prevented from being sent to the medium-pressure turbine 12.

The flow path on the outlet side 81Mb of the medium-pressure turbine bypass valve 82 is closed by the closing member 81D. The steam flowing into the internal space of the medium-pressure turbine bypass valve 82 from the medium-pressure bypass piping 42 flows into the flow path of the temporary piping 9.

The steam including the foreign matter in the medium-pressure steam piping 32 passes through the medium-pressure turbine bypass valve 82 and flows into the temporary piping 9. In the cleaning of the medium-pressure steam piping 32, the pressure of the steam in the temporary piping 9 is reduced by the pressure loss body 97 provided in the temporary piping 9 (Step SP4). If the pressure of the steam is reduced by the pressure loss body 97, the flow speed of the steam increases.

In this embodiment, the pressure loss body 97 is the temporary piping valve 97B, the degree of opening of which can be adjusted. A valve which is large in size and low in pressure loss is used as the temporary piping valve 97B of the pressure loss body 97. Steam is continuously supplied in a state where the degree of opening of the temporary piping valve 97B is adjusted such that the flow speed of the steam which is supplied to the inertial filter 6F becomes high.

The steam having passed through the pressure loss body 97 is sent to the foreign matter collecting portion 6 which includes the inertial filter 6F. The foreign matter included in the steam is collected by the foreign matter collecting portion 6 (Step SP5).

As shown in FIG. 9, the angle θa which is formed between the central axis AX1 of the first pipe section 91 and the central axis AX4 of the projecting section 94 is larger than the angle θb which is formed between the central axis AX1 of the first pipe section 91 and the central axis AX2 of the second pipe section 92. For this reason, the foreign matter which moves together with the steam in the flow path 91R of the first pipe section 91 flows exclusively into the internal space 94R of the projecting section 94 due to its inertial force. In other words, the amount of foreign matter moving from the flow path 91R to a flow path 92R is smaller than the amount of foreign matter moving from the flow path 91R to the internal space 94R. That is, the movement (inflow) of the foreign matter from the flow path 91R to the flow path 92R is suppressed. The foreign matter in the steam flowing through the flow path 91R is collected by the projecting section 94 functioning as the foreign matter collecting portion 6.

Further, in this embodiment, the angle θa is 180[°], and the first pipe section 91 and the projecting section 94 form a straight pipe. The angle θb is 90[°]. For this reason, the movement of the foreign matter in the flow path 91R to the flow path 92R is sufficiently suppressed.

The foreign matter is collected by the foreign matter collecting portion 6, whereby the foreign matter is prevented from being sent to the condenser 2.

The steam from which the foreign matter has been removed by the inertial filter 6F flows into the medium-pressure bypass piping 42 through the connecting portion 5, and thus intra-system blowing is carried out.

The steam is supplied to the desuperheater 4. In the cleaning of the piping system 1000, the temperature of the steam which is sent to the condenser 2 through the temporary piping 9 is reduced by the desuperheater 4 (Step SP6).

The steam having a temperature reduced by the desuperheater 4 is sent to the condenser 2 (Step SP7). Due to the desuperheater 4, steam having a high temperature is prevented from being supplied to the condenser 2. Further, in this embodiment, the protective member 200 is provided in the condenser 2. In this way, even if foreign matter that could not be collected by the foreign matter collecting portion 6 is sent to the condenser 2, due to the protective member 200, the foreign matter is prevented from coming into contact with the cooling pipe. By the above, the intra-system blowing is ended.

[Effects]

As described above, according to this embodiment, steam is supplied in a state where the medium-pressure turbine bypass valve 82 and the connecting portion 5 provided in the medium-pressure bypass piping 42 are connected by the temporary piping 9. A pressure loss of steam in a case where the temporary piping 9 is provided is smaller than a pressure loss of steam in a case where the temporary piping 9 is not provided. In a case where the temporary piping 9 is not provided, the steam passes through the medium-pressure turbine bypass valve 82 and flows out from the outlet side 81Mb of the medium-pressure turbine bypass valve 82. In that case, a pressure loss of steam is increased due to a structure such as a muffler provided inside of the medium-pressure turbine bypass valve 82. As a result, there is a possibility that sufficient cleaning power may not be obtained. The medium-pressure turbine bypass valve 82 and the connecting portion 5 are connected by the temporary piping 9, whereby there is no influence of a pressure loss due to the muffler of the medium-pressure turbine bypass valve 82. For this reason, steam having a high flow speed and a high flow rate can be caused to flow, and thus lack of cleaning power is prevented in the medium-pressure steam piping 32 and the medium-pressure bypass piping 42 on the upstream side of the medium-pressure turbine bypass valve 82, which are cleaning targets, and the high-pressure steam piping 31, the high-pressure bypass piping 41, and the low-temperature reheat steam piping 51 on the further upstream side.

Further, in this embodiment, the temporary piping 9 has the foreign matter collecting portion 6, and therefore, the foreign matter removed from the medium-pressure steam piping 32 is collected by the foreign matter collecting portion 6. In this way, the foreign matter is prevented from being sent to the condenser 2.

Further, according to this embodiment, the foreign matter collecting portion 6 includes the inertial filter 6F provided in the temporary piping 9. In this way, the foreign matter is efficiently collected by using an inertial effect. Further, a pressure loss in the foreign matter collecting portion 6 is suppressed compared to a general filtration filter, and therefore, lack of cleaning power is prevented.

Further, according to this embodiment, the pressure loss body 97 is provided upstream of the inertial filter 6F. Due to the pressure loss body 97, the pressure of steam is reduced and the flow speed of steam increases. Therefore, the inertial effect is increased, and thus the collection efficiency of foreign matter by the inertial filter 6F provided downstream of the pressure loss body 97 is improved.

Further, according to this embodiment, the pressure loss body 97 includes the temporary piping valve 97B which is provided in the temporary piping 9. In this way, the flow speed of the steam which is sent to the inertial filter 6F increases due to the temporary piping valve 97B provided immediately before the inertial filter 6F. For this reason, the foreign matter is efficiently collected by the inertial filter 6F. As the temporary piping valve 97B, a valve which is larger in size and lower in pressure loss than the turbine bypass valve 80 can be selected. In this way, a pressure loss of the steam is suppressed, and thus lack of the cleaning power is prevented. Further, the degree of opening of the temporary piping valve 97B can be adjusted, and therefore, the pressure and the flow speed of the steam can be adjusted.

Further, according to this embodiment, the inertial filter 6F has the first pipe section 91, the second pipe section 92, the bent portion 93, and the projecting section 94. In this way, it is possible to suppress an increase in pressure loss and smoothly collect the foreign matter in the projecting section 94 by using an inertial force.

Further, according to this embodiment, the desuperheater 4 is provided between the connecting portion 5 of the bypass piping 40 and the condenser 2. In this way, during each of the cleaning (blowing-out) and the normal operation, steam having a high temperature is prevented from being sent to the condenser 2.

In the embodiment described above, an example has been described in which the blowing-out is carried out in a state where the medium-pressure turbine bypass valve 82 and the connecting portion 5 provided in the medium-pressure bypass piping 42 are connected by the temporary piping 9. The blowing-out may be carried out in a state where the low-pressure turbine bypass valve 83 and the connecting portion 5 provided in the low-pressure bypass piping 43 are connected by the temporary piping 9. In this way, steam having a high flow speed and a high flow rate can be caused to flow without being affected by a pressure loss which is caused by the muffler of the low-pressure turbine bypass valve 82, and thus lack of cleaning power is prevented in the low-pressure steam piping 33 and the low-pressure bypass piping 43 on the upstream side of the low-pressure turbine bypass valve 83, which are cleaning targets.

In the embodiment described above, the blowing-out is carried out in a state where the turbine bypass valve (the medium-pressure turbine bypass valve 82) and the connecting portion 5 are connected by the temporary piping 9. The blowing-out may be carried out in a state where the steam check valve 60 (the medium-pressure main steam valve 62) and the connecting portion 5 are connected by the temporary piping 9. Also in this case, steam having a high flow speed and a high flow rate can be caused to flow without being affected by a pressure loss which is caused by the muffler of the steam check valve 60. Therefore, lack of cleaning power is prevented in the steam piping 30 on the upstream side of the steam check valve 60, which is a cleaning target.

In the embodiment described above, the angle θa is set to be 180[°] and the angle θb is set to be 90[°]. The angle θa may be larger or may be smaller than 180[°]. The angle θb may be larger or may be smaller than 90[°]. The angle θa is larger than the angle θb, whereby the foreign matter is collected in the internal space 94R of the projecting section 94.

In the embodiment described above, continuous blowing in which steam is continuously supplied is carried out in a state where the degree of opening of the temporary piping valve 97B has been adjusted. Intermittent blowing may be carried out in which an operation of supplying steam and an operation of stopping the supply of steam are repeated by repeating a state where the temporary piping valve 97B is opened and a state where the temporary piping valve 97B is closed. The temporary piping valve 97B is opened and closed, whereby the steam flowing into the temporary piping 9 is intermittently supplied to the inertial filter 6F. The steam from the turbine bypass valve 80 flows into the temporary piping 9 in a state where the temporary piping valve 97B is closed, whereby the pressure on the further upstream side with respect to the temporary piping valve 97B increases. The temporary piping valve 97B is opened in a state where the pressure on the further upstream side with respect to the temporary piping valve 97B has increased, whereby the flow speed of the steam which is supplied to the inertial filter 6F can be sufficiently increased. The intermittent blowing in which a state where the temporary piping valve 97B is opened and a state where the temporary piping valve 97B is closed are repeated is carried out, whereby steam having a high flow speed is intermittently supplied to the inertial filter 6F. In this way, the collection efficiency of the foreign matter by the inertial filter 6F is improved.

Modification Example 1

Figure 11:
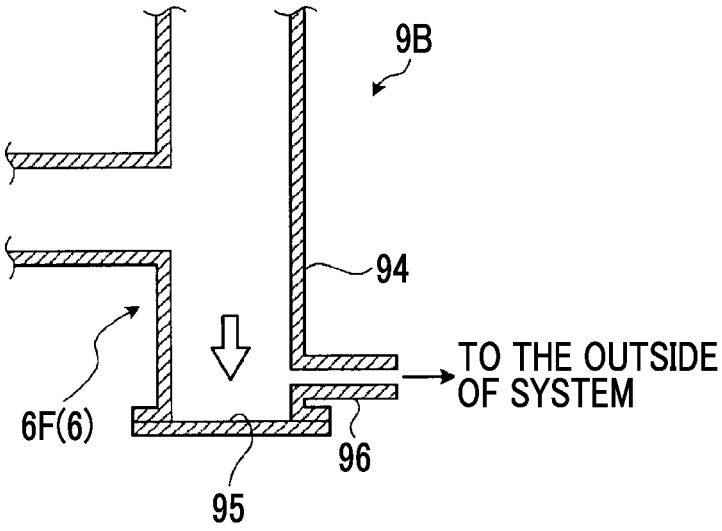
FIG. 11 is a sectional side view showing a modification example of the temporary piping.

Hereinafter, modification examples will be described. FIG. 11 is a diagram showing a modification example of a temporary piping 9B. Similarly to the embodiment described above, the temporary piping 9B has the projecting section 94. In this modification example, the projecting section 94 is connected to a discharge pipe 96 communicating with the outside of the piping system 1000. In the cleaning of the piping system 1000, at least some of the foreign matter collected in the projecting section 94 of the inertial filter 6F is discharged to the outside of the piping system 1000 through the discharge pipe 96.

At least some of the foreign matter collected in the projecting section 94 in the cleaning of the piping system 1000 is discharged to the outside of the piping system 1000 through the discharge pipe 96, and therefore, the foreign matter is prevented from staying at the projecting section 94 and back-flow of the foreign matter into the piping system 1000 is prevented.

Modification Example 2

Figure 12:
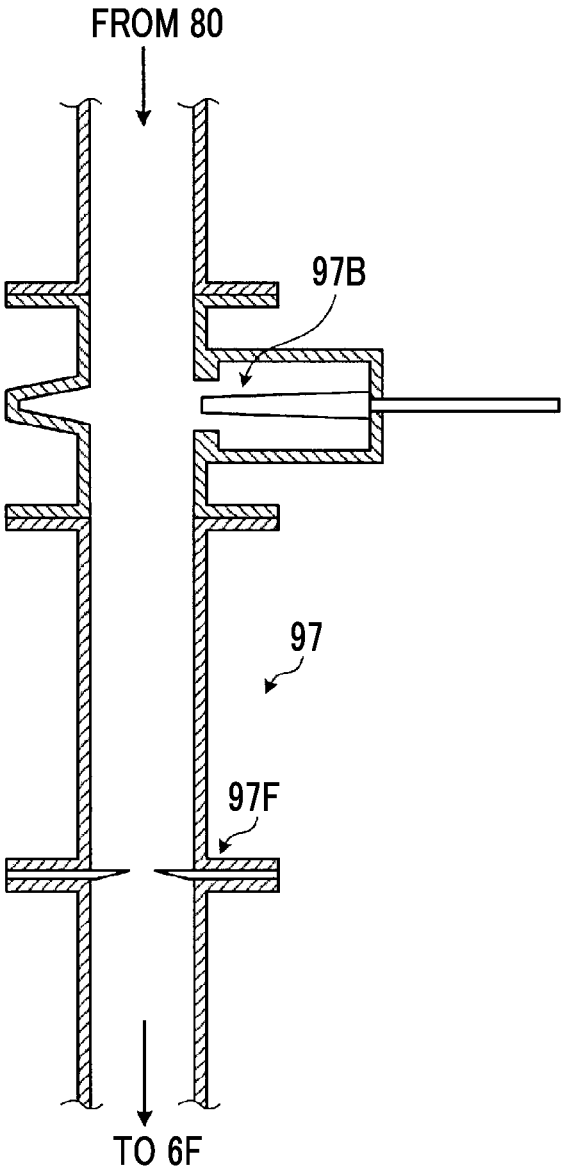
FIG. 12 is a sectional side view showing a modification example of a pressure loss body.

FIG. 12 is a diagram showing a modification example of the pressure loss body 97. The pressure loss body 97 may include an orifice 97F as shown in FIG. 12. The pressure of the steam is adjusted by the orifice 97F, and thus the flow speed of the steam is adjusted. Further, as shown in FIG. 12, the temporary piping valve 97B may be provided upstream of the orifice 97F. Intermittent blowing is carried out by opening and closing the temporary piping valve 97B. In the example shown in FIG. 12, the temporary piping valve 97B may not be provided. Continuous blowing in which high-speed steam is continuously supplied may be carried out by using the orifice 97F.

Modification Example 3

Figure 13:
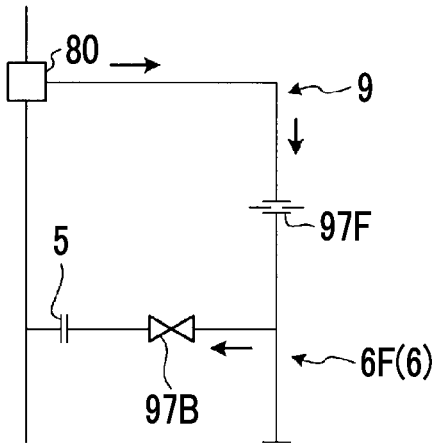
FIG. 13 is a schematic diagram showing a modification example of the pressure loss body.

FIG. 13 is a diagram showing a modification example of the pressure loss body 97. As shown in FIG. 13, a configuration may be made in which the orifice 97F is provided upstream of the inertial filter 6F and the temporary piping valve 97B is provided downstream of the inertial filter 6F. In the example shown in FIG. 13, the orifice 97F is provided between the turbine bypass valve 80 and the inertial filter 6F in the temporary piping 9. The temporary piping valve 97B is provided between the inertial filter 6F and the connecting portion 5 in the temporary piping 9. The flow speed of the steam which is supplied to the inertial filter 6F can be increased by the orifice 97F. Intermittent blowing is carried out by repeating a state where the temporary piping valve 97B is opened and a state where the temporary piping valve 97B is closed.

The pressure loss body 97 may not be provided in the temporary piping 9. It is acceptable if the pressure loss body 97 is provided upstream of the inertial filter 6F, and the pressure loss body 97 may be provided in, for example, the bypass piping 40 upstream of the turbine bypass valve 80.

Figure 14:
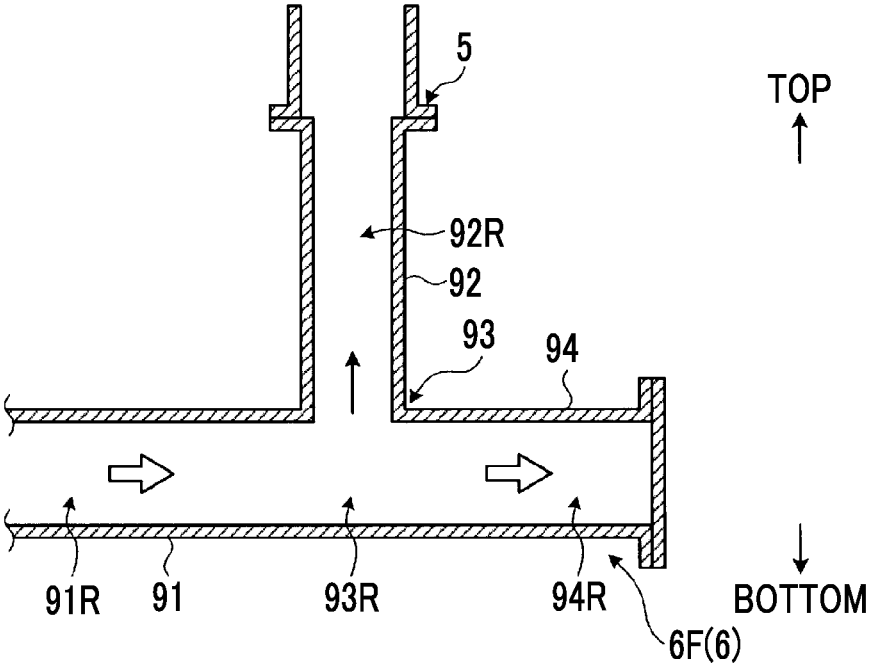
FIG. 14 is a schematic diagram showing a modification example of the piping system.

In each of the embodiments described above, as shown in FIG. 14, it is preferable that the second pipe section 92 of the inertial filter 6F is disposed above the first pipe section 91 and the projecting section 94. In this way, even if at least some of the foreign matter in the steam flowing through the first pipe section 91 flows into the second pipe section 92, the foreign matter flowing into the second pipe section 92 falls into the flow path 93R of the bent portion 93 due to the action of gravity and is collected by the projecting section 94.

In each of the embodiments described above, the inertial filter 6F has the bent portion 93 and the projecting section 94. The inertial filter 6F may be a filter member having a plurality of mesh-like holes. The filter member is disposed in the flow path of the temporary piping 9 through which the steam which includes the foreign matter flows. The filter member collects the foreign matter flowing through the temporary piping 9 by using a particle inertia effect. The filter member collects foreign matter having a smaller grain size as the flow speed of the steam is higher.

In the embodiments described above, the steam turbine plant 1 is set to be a part of a gas turbine combined cycle. However, it is not necessarily limited thereto. The steam turbine plant 1 may be a conventional thermal power generation facility which does not use gas turbine exhaust heat as a heat source. Further, the use thereof is not limited to a use for power generation, and the steam turbine plant 1 may be, for example, a steam turbine plant provided with a steam turbine for the driving of a machine. Further, the working fluid thereof is also not limited to water, and the steam turbine plant may be, for example, a steam turbine plant using an organic medium which evaporates at a lower temperature than water.

REFERENCE SIGNS LIST

1: steam turbine plant
2: condenser
3: check valve
4: desuperheater
5: connecting portion
5F: flange section
5M: opening
6: foreign matter collecting portion
6F: inertial filter
7: closing member
9: temporary piping
9F: flange section
10: steam turbine
11: high-pressure turbine
12: medium-pressure turbine
13: low-pressure turbine
20: steam generator
21: high-pressure heating unit
22: medium-pressure heating unit
23: low-pressure heating unit
24: reheat unit
30: steam piping
31: high-pressure steam piping
32: medium-pressure steam piping
33: low-pressure steam piping
40: bypass piping
41: high-pressure bypass piping
42: medium-pressure bypass piping
43: low-pressure bypass piping
51: low-temperature reheat steam piping
52: piping

60: steam check valve
61: high-pressure steam check valve
62: medium-pressure steam check valve
63: low-pressure steam check valve
70: control valve
71: high-pressure control valve
72: medium-pressure control valve
73: low-pressure control valve
80: turbine bypass valve
81: high-pressure turbine bypass valve
81A: housing
81B: valve body
81C: lid member
81D: closing member
81Ma: inlet side
81Mb: outlet side
82: medium-pressure turbine bypass valve
83: low-pressure turbine bypass valve
91: first pipe section
91R: flow path
92: second pipe section
92R: flow path
93: bent portion
93R: flow path
94: projecting section
94R: internal space
95: closing part
96: discharge pipe
97: pressure loss body
97B: temporary piping valve
97F: orifice
100: branching portion
200: protective member
1000: piping system
AX1: central axis
AX2: central axis
AX4: central axis

The invention claimed is:

1. A piping system cleaning method in a steam turbine plant, in which the piping system includes steam piping which is connected to a steam turbine, bypass piping which branches from the steam piping at a branching portion and is connected to a condenser, a steam check valve which is provided between the branching portion of the steam piping and the steam turbine, and a turbine bypass valve which is provided in the bypass piping, the method comprising the steps of:

connecting a housing of the turbine bypass valve and a connecting portion provided between the turbine bypass valve of the bypass piping and the condenser, the turbine bypass valve and the connecting portion being connected by using temporary piping having a foreign matter collecting portion, the connection portion having an opening provided in a middle of the bypass piping connecting an outlet of the turbine bypass valve and the condenser;

closing a flow path on the outlet side of the turbine bypass valve;

cleaning the steam piping by supplying steam to the steam piping; and sending the steam to the condenser through the temporary piping, wherein the foreign matter collecting portion includes an inertial filter provided in the temporary piping, a pressure loss body, which causes a pressure loss of the steam flowing through the temporary piping, is provided upstream of the inertial filter of the temporary piping, in cleaning of the piping system, pressure of the steam in the temporary piping is reduced by the pressure loss body, the pressure loss body includes a temporary piping valve which is provided in the temporary piping, and the degree of opening of the temporary piping valve is adjusted such that pressure and flow speed of the steam are adjusted.

2. The piping system cleaning method according to claim 1, wherein the inertial filter has a first pipe section which is connected to the turbine bypass valve, a second pipe section which is connected to the connecting portion, a bent portion which connects the first pipe section and the second pipe section, and a projecting section which is connected to the bent portion in an extension line direction of the first pipe section and has an internal space communicating with a flow path of the bent portion.

3. The piping system cleaning method according to claim 2, wherein the projecting section is connected to a discharge pipe communicating with the outside of the piping system, and in cleaning of the piping system, at least some of foreign matter collected in the projecting section is discharged to the outside of the piping system through the discharge pipe.

4. The piping system cleaning method according to claim 1, wherein a desuperheater which reduces a temperature of the steam is provided between the connecting portion of the bypass piping and the condenser, and in cleaning of the piping system, a temperature of the steam which is sent to the condenser through the temporary piping is reduced by the desuperheater.

* * * * *